US005154238A

United States Patent [19]

Buchan

[11] Patent Number: 5,154,238

[45] Date of Patent: Oct. 13, 1992

[54] VEHICULAR FIRE PROTECTION APPARATUS

[76] Inventor: Gorden M. Buchan, 27843 Lost Springs Rd., Canyon Country, Calif. 91351

[21] Appl. No.: 732,615

[22] Filed: Jul. 19, 1991

[51] Int. Cl.[5] ..... A62C 3/07; A62C 3/08; A62C 3/00; A62C 2/08

[52] U.S. Cl. ..... 169/62; 169/52; 169/48; 169/54; 169/61; 169/70; 244/129.2; 296/208

[58] Field of Search ..... 169/62, 70, 52, 54, 169/61, 48; 244/129.2, 121, 114 R; 296/208

[56] References Cited

U.S. PATENT DOCUMENTS

| | | | |
|---|---|---|---|
| 2,055,590 | 9/1936 | Pugnet | 169/62 X |
| 2,857,005 | 10/1958 | Medlock | 169/62 |
| 3,993,139 | 11/1976 | Vaughn | 169/62 |
| 4,091,876 | 5/1978 | Valdatta | 169/62 |
| 4,219,084 | 8/1980 | Gray et al. | 169/62 X |

FOREIGN PATENT DOCUMENTS

| | | | |
|---|---|---|---|
| 227255 | 7/1987 | European Pat. Off. | 169/62 |
| 643160 | 1/1979 | U.S.S.R. | 169/62 |
| 860777 | 9/1981 | U.S.S.R. | 169/62 |
| 2019213 | 10/1979 | United Kingdom | 169/62 |

*Primary Examiner*—Margaret A. Focarino
*Assistant Examiner*—James M. Kannofsky
*Attorney, Agent, or Firm*—Leon Gilden

[57] ABSTRACT

A fire protection apparatus includes spray nozzles oriented specifically adjacent engines associated with transport vehicles. The transport vehicles each include engine conduits for quick coupling to fire extinguishing agent conduits to permit remote coupling to a vehicle directing fire extinguishing agents such as halon gas and carbon dioxide to the engine for extinguishment of an associated fire.

4 Claims, 5 Drawing Sheets

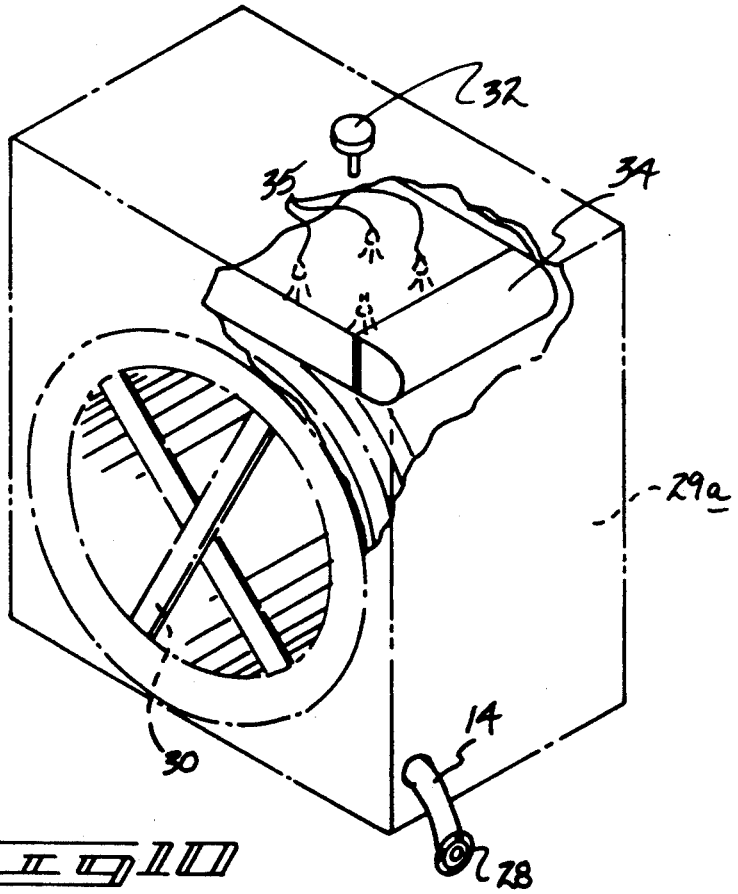
Fig 10
Fig 11
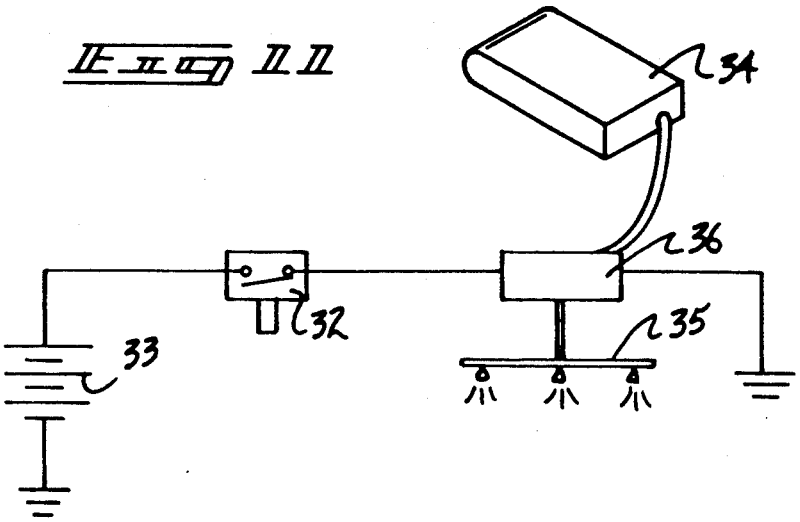

VEHICULAR FIRE PROTECTION APPARATUS

BACKGROUND OF THE INVENTION

1. Field of the Invention

The field of invention relates to fire extinguishing apparatus, and more particularly pertains to a new and improved vehicular fire extinguishing apparatus wherein the same is arranged to permit coupling from a fire extinguishing agent supply conduit to a vehicular conduit to precisely direct the fire extinguishing agent to a vehicular engine.

2. Description of the Prior Art

Typically vehicles, to include aircraft, land vehicles, ships, and the like, include engines operative through combustible agents such as gasoline for operation of the engines. In event of fire, immediate access to the engines and the associated fire is unreasonable due to relative heat, smoke, and the like. The instant invention attempts to overcome deficiencies of the prior art by providing nozzles and directing conduits to specifically direct a fire extinguishing agent to an associated engine fire permitting remote coupling to a fire extinguishing agent supply conduit. Prior art apparatus is exemplified in U.S. Pat. No. 4,351,394 to Enk wherein an aircraft utilizes an on-board supply of fire extinguishing agent and associated conduits.

U.S. Pat. No. 4,197,914 to Gray sets forth cargo transport vehicles including fluid carrying conduits supported on the other side of a hatch cover for connection to a source of fluid remote from the hatch.

U.S. Pat. No. 4,361,189 to Adams sets forth a dwelling including an automatic fire extinguishing and alarm system for use for example in mobile homes.

U.S. Pat. No. 4,566,542 to Enk, et al. sets forth a fire protection system for aircraft, wherein on-board fire extinguishing bottles are directed through a valve manifold into various portions of an aircraft, wherein the bottles are selectively operative or are simultaneously operative upon event of a crash.

Accordingly, it may be appreciated that there continues to be a need for a new and improved vehicular fire protection apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of vehicular fire protection apparatus now present in the prior art, the present invention provides a vehicular fire protection apparatus wherein the same is arranged for remote coupling to on-board hoses mounted within an associated vehicle to direct fire extinguishing spray onto a vehicle engine. As such, the general purpose of the present invention, which will be described subsequently in greater detail, is to provide a new and improved vehicular fire protection apparatus which has all the advantages of the prior art vehicular fire protection apparatus and none of the disadvantages.

To attain this, the present invention provides a fire protection apparatus including spray nozzles oriented specifically adjacent engines associated with transport vehicles. The transport vehicles each include engine conduits for quick coupling to fire extinguishing agent conduits to permit remote coupling to a vehicle directing fire extinguishing agents such as halon gas and carbon dioxide to the engine for extinguishment of as associated fire.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicular fire protection apparatus which has all the advantages of the prior art vehicular fire protection apparatus and none of the disadvantages.

It is another object of the present invention to provide a new and improved vehicular fire protection apparatus which may be easily and efficiently manufactured and marketed.

It is a further object of the present invention to provide a new and improved vehicular fire protection apparatus which is of a durable and reliable construction.

An even further object of the present invention is to provide a new and improved vehicular fire protection apparatus which is susceptible of a low cost of manufacture with regard to both materials and labor, and which accordingly is then susceptible of low prices of sale to the consuming public, thereby making such vehicular fire protection apparatus economically available to the buying public.

Still yet another object of the present invention is to provide a new and improved vehicular fire protection apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is a modified construction of the hose support housing.

FIG. 11 is a diagrammatic illustration of circuitry utilized by the modified housing, as illustrated in FIG. 10.

DESCRIPTION OF THE PREFERRED EMBODIMENT

Figure 1:
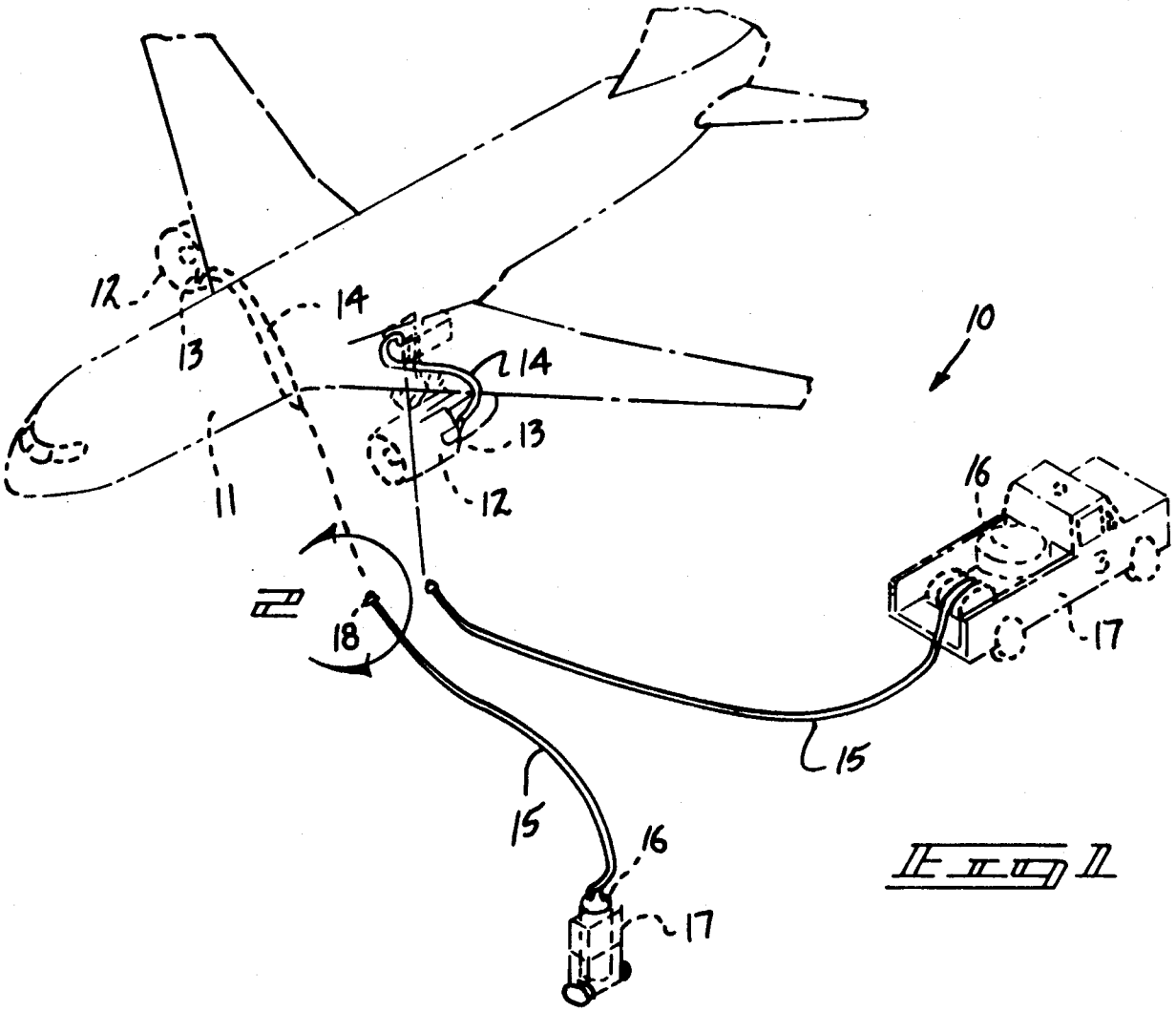
FIG. 1 is an isometric illustration of the invention in use.

With reference now to the drawings, and in particular to FIGS. 1 to 11 thereof, a new and improved vehicular fire protection apparatus embodying the principles and concepts of the present invention and generally designated by the reference numeral 10 will be described.

More specifically, the vehicular fire protection apparatus 10 comprises, as illustrated in FIG. 1 in association with an aircraft 11 that includes a plurality of engines 12. Each engine includes an engine spray nozzle 13 associated with each engine, with an engine conduit 14 mounted within the aircraft 11 in fluid communication with each respective spray nozzle 13. A fire extinguishing agent such as Halon gas or carbon dioxide is mounted within a supply cartridge 16 supported upon a support vehicle 17 that is generally mobile in transporting the supply cartridge 16 relative to the associated aircraft 11 or other associated vehicle. A quick-connect coupling 18 (see FIG. 2) is utilized with end portions 19 to secure the fire extinguishing agent conduit 15 to the engine conduit 14.

Figure 6:
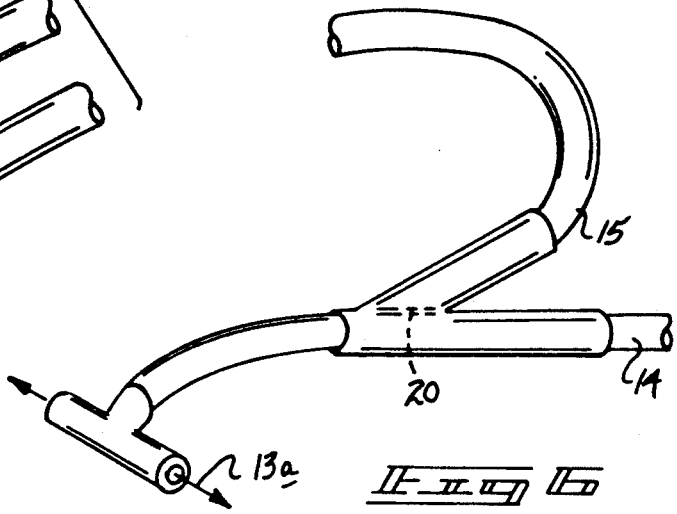
FIG. 6 is an isometric illustration of a coupling to associate the fire extinguishing conduit with the on-board vehicle conduit utilizing one-way valve.
Figure 7:
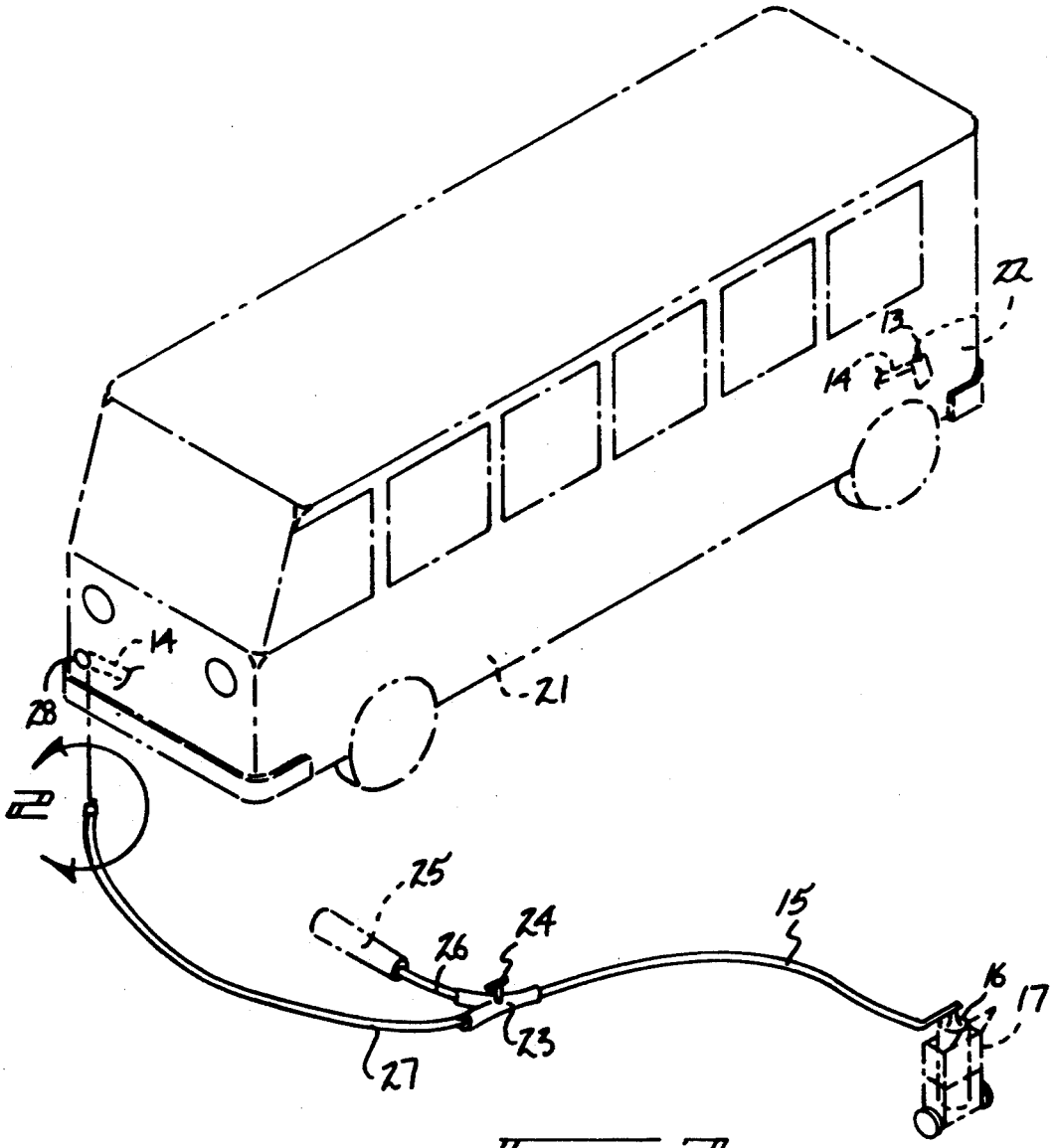
FIG. 7 is an isometric illustration of the instant invention for association with a land vehicle.

FIG. 6 illustrates a first "Y" connector, including a one-way valve 20 mounted therewithin to associate the fire extinguishing agent conduit 15 with the engine conduit 14 and further direct the fire extinguishing agent through a plurality of spray nozzle conduits 13*a* to the associated spray nozzles 13. FIG. 7 illustrates the use of a land transport vehicle 21, including an engine 22 mounted at a rear end portion of the transport vehicle, including an engine conduit 14 directed from the engine 22 through a front end portion of the vehicle to a vehicle coupling 28 to utilize the coupling 18 to associate the coupling to the vehicle.

Figure 2:
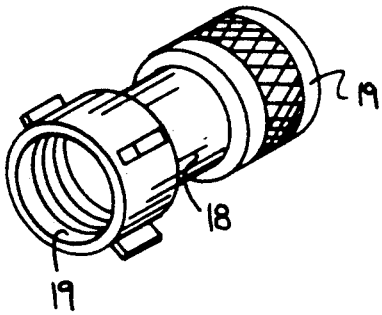
FIG. 2 is an isometric illustration of the quick coupling member utilized by the invention, as set forth in section 2 of FIG. 1.
Figure 3:
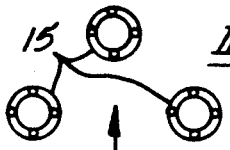
FIG. 3 is an orthographic frontal view, taken in elevation, of the various fire extinguisher agent delivery conduits for association with the respective engines of an aircraft.
Figure 4:
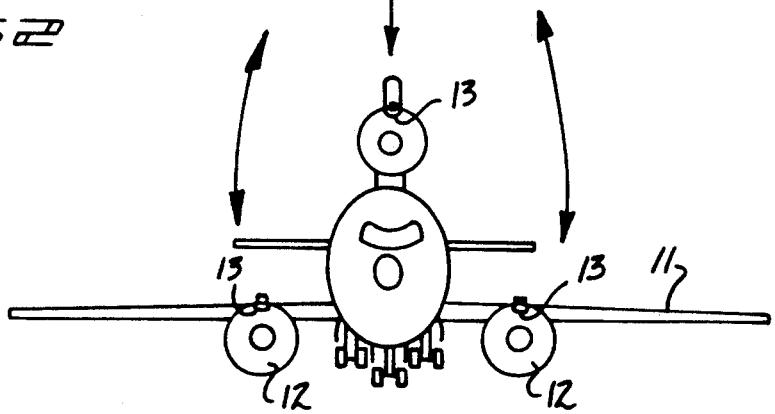
FIG. 4 is an orthographic frontal view of a vehicular airplane in association with the instant invention.
Figure 5:
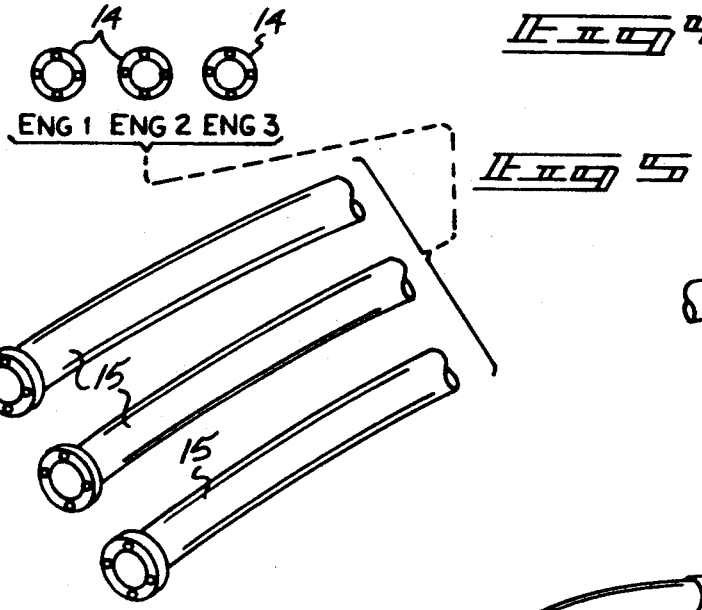
FIG. 5 is an isometric illustration of the fire extinguisher transport conduits for securement to the on-board engine conduits.

The support vehicle 17 mounts the supply cartridge 16 thereon, and includes the fire extinguishing agent conduit 15 directing the fire extinguishing agent from the supply cartridge 16. A "Y" connection 23 is provided to include a valve plate 24 to permit directing sequentially or simultaneously the fire extinguishing agent to a first outlet hose 26 that includes a manually directed first nozzle 25 and a second outlet hose 27 mounted to the "Y" connector 23 to direct the fire extinguishing agent to the vehicle coupling 28 mounted within the front end wall of the transport vehicle 21 utilizing the coupling 18, as illustrated in FIG. 2.

Figure 8:
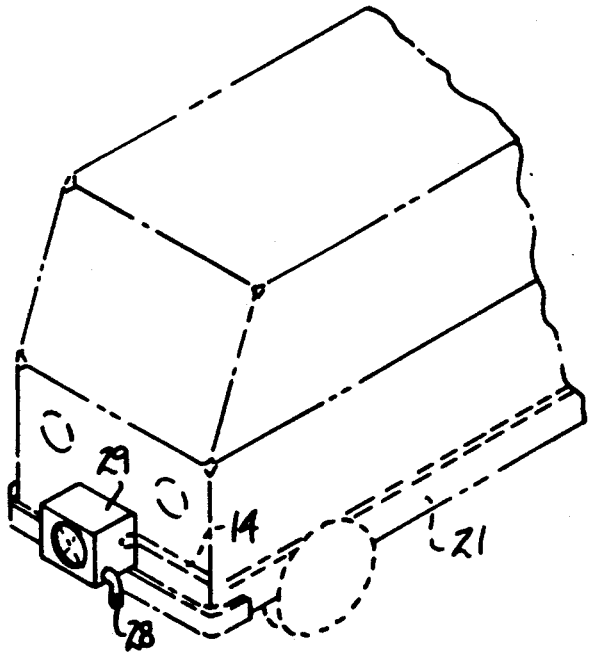
FIG. 8 is an isometric illustration of the land vehicle mounting modified hose support container.
Figure 9:
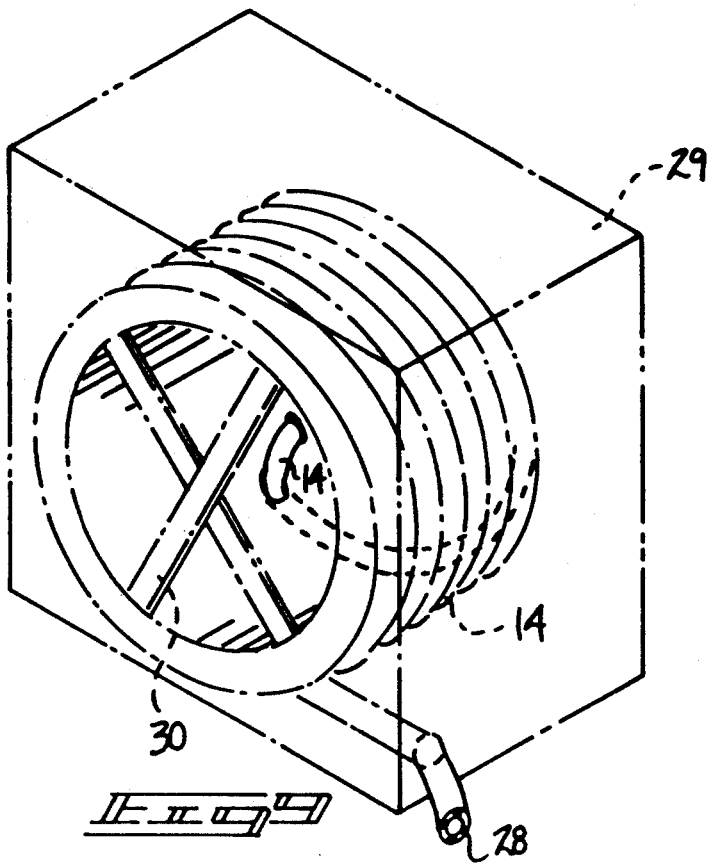
FIG. 9 is an enlarged isometric illustration of the hose support container, as illustrated in FIG. 8.

FIG. 8 illustrates a vehicle support housing 29 mounted on the front end of the vehicle that includes the engine conduit 14 wound about an associated spool 31 in a rotatable manner. The support housing 29 includes the vehicle coupling 28 mounted at a free end thereof for securement to the second outlet hose 27. The modified housing 29*a*, as illustrated in FIG. 10, includes a heat sensor switch 32 in electrical communication with the vehicular battery 33 contained within the associated vehicle that effects selective actuation of a spray nozzle valve 36 to direct cooling fluid from a spray housing pressurized fluid storage tank 34 contained within the vehicle 21 and direct the fluid through the matrix of fluid spray nozzles 35 positioned in an overlying relationship relative to the spool 30 to effect cooling of the engine conduit 14 to keep the conduit at a depressed temperature to permit ease of handling, as well as safety and thereby permitting more remote positioning of the vehicle coupling 28 relative to the vehicle 21 in the event of a fire to position an individual in a remote orientation relative to such vehicle to minimize danger due to explosion and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vehicular fire protection apparatus, comprising, a vehicle, the vehicle including at least one vehicle engine, the at least one vehicle engine including an engine spray nozzle positioned adjacent the engine, and an engine conduit in fluid communication with the engine spray nozzle directed through the vehicle and having a first part projecting through an exterior surface of the vehicle, and a vehicle coupling in fluid communication with the engine conduit, and a fire extinguishing agent conduit, the fire extinguishing agent conduit including a coupling, the coupling arranged for securement to the fire extinguishing agent conduit and the vehicle coupling, and the fire extinguishing agent conduit in fluid communication with a fire extinguishing agent supply cartridge, the fire extinguishing agent supply cartridge mounted within a support vehicle.

2. An apparatus as set forth in claim 1 wherein the fire extinguishing agent conduit includes a "Y" junction, the "Y" junction including a valve plate, the valve plate selectively directing a fire extinguishing agent from the fire extinguishing agent conduit selectively to a first outlet hose and a second outlet hose, the first outlet hose in fluid communication with the "Y" junction mounted to a first nozzle, and the second outlet hose mounted to the "Y" junction mounted to the coupling for securement to the vehicle coupling.

3. An apparatus as set forth in claim 2 wherein the vehicle further includes a vehicle support housing, the vehicle support housing including a second part of the engine conduit contained therewithin, with a spool rotatably mounted within the vehicle support housing, the spool rotatably mounting the second part of the engine conduit thereabout, wherein the first part of the engine conduit is secured to the vehicle coupling and is selectively directed through the support housing for extension of the engine conduit relative to the support housing.

4. An apparatus as set forth in claim 3 wherein the support housing includes a matrix of fluid spray nozzles mounted within the housing in an overlying relationship relative to the spool, and a heat sensor switch mounted to the housing and projecting exteriorly of the housing, and the heat sensor switch in electrical communication with a vehicular battery, and a spray nozzle valve in operative communication with the heat sensor switch, wherein actuation of the heat sensor switch effects opening of the spray nozzle valve, and a spray housing pressurized fluid storage tank contained within the transport vehicle, wherein actuation of the heat sensor switch directs fluid from the spray housing pressurized fluid storage tank through the spray nozzle valve into the matrix of fluid spray nozzles, and each fluid spray nozzle of the matrix of fluid spray nozzles is positioned adjacent to and above the spool to effect cooling of the engine conduit wound about the spool.

* * * * *